United States Patent [19]

Bogucki-Land et al.

[11] Patent Number: 5,046,224

[45] Date of Patent: Sep. 10, 1991

[54] PROCESS FOR CHANGING WARP BEAM ON A WARPING ARRANGEMENT AND APPARATUS THEREFOR

[75] Inventors: Bogdan Bogucki-Land, Offenbach; Karl W. Michelmann, Grundau, both of Fed. Rep. of Germany

[73] Assignee: Karl Mayer Textilmaschinenfabrik GmbH, Obertshausen, Fed. Rep. of Germany

[21] Appl. No.: 506,681

[22] Filed: Apr. 9, 1990

[30] Foreign Application Priority Data

Apr. 22, 1989 [DE] Fed. Rep. of Germany ..... 3913249

[51] Int. Cl.[5] ..... D02H 5/00; B65H 19/28

[52] U.S. Cl. ..... 28/190; 242/56 A

[58] Field of Search ..... 242/56 A, 56 R, 64, 242/68.4; 28/190

[56] References Cited

U.S. PATENT DOCUMENTS

| | | | |
|---|---|---|---|
| 2,736,508 | 2/1956 | Langbo | 242/56 A |
| 2,969,930 | 1/1961 | Zernov | 242/56 A |
| 3,075,719 | 1/1963 | Hornstein et al. | 242/68.4 |
| 3,115,315 | 12/1963 | Dunlap, Jr. et al. | 242/64 |
| 3,684,202 | 8/1972 | Otani et al. | 242/56 A X |
| 3,841,577 | 10/1974 | Phelps et al. | 242/56 A |
| 4,458,851 | 7/1984 | Tokuno et al. | 242/68.4 X |

FOREIGN PATENT DOCUMENTS

| | | | |
|---|---|---|---|
| 982521 | 1/1976 | Canada | 242/56 A |
| 2139928 | 2/1973 | Fed. Rep. of Germany | 242/56 A |
| 2126564 | 3/1974 | United Kingdom | 242/56 A |

*Primary Examiner*—Werner H. Schroeder
*Assistant Examiner*—John J. Calvert
*Attorney, Agent, or Firm*—Omri M. Behr

[57] ABSTRACT

A process changing of a beam for taking up a thread sheet on a warping arrangement in which a first fully wound beam is discharged from a winding position, comprising the steps of loading an un-wound second beam into the winding position, bringing the thread sheet into contact with the second beam, attaching the thread sheet to said second beam and severing said thread sheet from the first beam while the first beam is still held in the warping arrangement.

18 Claims, 3 Drawing Sheets

PROCESS FOR CHANGING WARP BEAM ON A WARPING ARRANGEMENT AND APPARATUS THEREFOR

FIELD OF THE INVENTION

The invention is concerned with a process for changing the beam for taking up a thread sheet in a warping arrangement, wherein a first fully wound beam is moved out of the winding position, as well as a warping arrangement therefore.

BACKGROUND OF THE INVENTION

Heretofore in known warping arrangements, when a fully warped beam is to be removed, it is necessary that the warping arrangement be stopped, the beam taped up, packed, and removed from the arrangement and an empty beam provided to the arrangement, before the arrangement can be started up again. Even in an efficiently organized operation, such a beam change requires 10 to 15 minutes and a substantial utilization of personnel. Needless to say, during this time, the arrangement cannot be operated. While such arrangements are known for the winding of individual strands (DE OS 29 397 17 and DE 19 339 23), they are not suitable for the beaming of thread sheets.

SUMMARY OF THE INVENTION

It is object of this invention to provide a means for changing the beam which utilizes the warping machine in a more effective manner. This task is achieved in a process as described above, wherein a second un-wound beam is moved into the winding position, the thread sheet and the second beam are brought into contact on the arrangement, the thread sheet connected to the second beam and servered from the first beam, while the first beam is still held in the warping arrangement. The change of beams thus occurs through a direct relieving of the first beam by the second beam. Only when the thread sheet is attached to the second beam, is the connection of the thread sheet to the first beam broken. The severing can take place anywhere between the fastening point on the second beam to any point up to the connection with the first beam. Only when the second beam has totally taken over the thread sheet will the first beam be released from its responsibility and can be removed from the arrangement.

The result of such a process is that the time in which the warping arrangement is at rest, can be limited to 1 to 2 minutes. A single service person can thus supervise the beam change in several arrangements. The process can be more readily automated than heretofore. Furthermore, the change in beams is less dangerous and less energy consuming for the service person. Both beams, that is to say, the wound and the un-wound, can be more efficiently utilized, since the one still holds the thread sheet while it is being affixed to the other. This gives rise to a far more efficient procedure, since the thread sheet is only released from its tensioned, that is to say, properly oriented position, when it can no longer influence the warping process.

In a preferred embodiment, the discharge of the first beam occurs simultaneously with the loading of the second beam. It is also possible to provide that the loading of the second beam follows the discharge of the first beam. The simultaneous movement of both beams, at least for a portion of the motion, reduces the time span in which the arrangement must be at rest, that is to say, cannot proceed with warping.

It is further advantageous if the discharge and loading movements of the beams are carried out by swinging movements. Swinging movements are easy to control. Furthermore, they permit a type of cyclic procedure since swinging movements are not angularly limited.

In a particularly preferred embodiment, the first beam is moved out of the winding position into a packing position, in which it is accessible from all sides and then moved into the release position from which it is removed from the warping arrangement. In the release position, a third beam is provided while the second beam is being wound. The winding of the second beam can thus be begin as soon as it is moved into the winding position, the thread sheet is attached to it and severed from the first beam. The packing of the first beam which occurs in the packing position does not interfere with the winding process. Since the first beam is accessible from all sides in the packing position, a rapid and convenient packing of the beam is possible which again leads to a saving in time and personnel. The release position is so provided that the beam is laid onto the ground or onto a suitable pallet so that it can be more readily transported elsewhere. In this position, the third un-wound beam, which should be wound after the second beam, is preloaded. The third beam can be cleaned and prepared in the release position. It is, however, more convenient if the third beam is swung back into the packing position since then it is more readily accessible to the service personnel and work is facilitated.

It is advantageous for the thread sheet to be cut at the second beam. This removes the presence of undesired threads ends at the second beam which could interfere with further beaming or winding. Thus, right from the first layer of threads on the beam, it is possibe to provide for an even winding.

Preferably, the connection of the thread sheet to the second beam and the cutting of the thread sheet on the first beam occurs simultaneously. By combining these two steps into a single working step, there is again a saving of time which again reduces the time during which the arrangement cannot operate.

In accordance with the present invention, there is provided a warping arrangement, in particular one suited to carrying out the foregoing process, comprising a first beam carrying means which takes up a removable, rotatably borne beam and is moveable and fixable in at least two positions of which one is the winding position for the warping of a thread sheet and a second beam carrier which carries a second, removable and rotatable beam which is moveable into and fixable in the same positions, whereby the second beam carrier, is moveable into the winding position either during or after a position change of the first beam carrier.

Thus, the arrangement comprises two mutually independent movable and suitably rotatable, beam carriers which can move an empty un-wound beam into the winding position. The carriers simultaneously serve to move the wound or fully warped beams from the winding position. This discharge movement requires the initiation of the loading movement since otherwise, the wound beam would collide with the empty beam. With this arrangement, a step-wise but continuous process is possible, wherein the movement paths of the loading movement and the discharge movement are decoupled from each other but operate in the same direction. This avoids the possibility of collision whereby the working speed is raised. The loading times, that is to say, the times wherein the arrangement must be at rest because beam changes are occuring, are thus reduced. Since the wound beam is moved out of the winding position and does not interfere with the movement of the second beam into the winding position, the latter can be wound while the first beam is being further processed.

It is advantageous if the second and first beam carriers are provided as levers which are rotatable about a common axis. The swinging movement which the levers execute can be readily controlled. Furthermore, this type of operation facilitates a type of cyclic movement since the swinging angle is not limited. The beams are moved out of the winding position in the same direction as they are moved into the winding position.

In a preferred arrangement, the beam carriers are moveable into three different positions in which they are fixable. The first being the winding position, the second being the packing position in which the fully wound beam is accessible from all sides, and the third is release position in which the beam is placeable upon a support means and releasable from the carrier. After the warping step, the fully wound beam is first swung into the packing position where the service person can readily provide packing materials since the beam is accessible from all sides. After the packing step, the relatively heavy beam is lowered and can be set down on a support means and released from the carrier and transported away from the arrangement. Thus, the carrier is now free and a new, empty beam, can be attached to it. The packing and changing of the beams can thus occur during the time in which the second beam is already being wound. This gives rise to a very efficient mode of operation. It is advantageous to provide that each of the beam carries are provided with separate drives, both for rotation of the beam and swinging of the carrier beams about the common axis. Each beam can thus be individually contolled. This is particularly advantageous because the newly engaged beam can be swung from the release or removal position back into the packing position. This simplifies the preparation, that is to say, the cleaning of the beam and the ulimate provision of an adhesive strip for the attachment of the thread sheet. When the preparation is complete, the beam can again be moved into the removal position from which it can be moved into the winding position when the beam being wound has been fully wound and moved out of the winding position.

It is advantageous to provide an affixing or attaching arrangement wherein the thread sheet is moved against an empty beam in the winding position. The attaching arrangement serves to bring the thread sheet into contact with the empty beam, which had been swung into the winding position and to affix it thereto. The adhesion may be generally achieved by providing an adhesive strip to the beam so that it is sufficient to press the thread sheet briefly to said adhesive strip.

In an especially preferred embodiment, the thread securing arrangement also comprises a thread severing arrangement. Thus, the attachment of the thread sheet on the beam which has been moved into the winding position and the severing of the thread sheet from the beam which has been moved out of the winding position, can take place in a single working step. It is advantageous to provide the servering arrangement as a glow-wire. The glow wire can simultaneously operate as a fixing arrangement. It is moved against the thread sheet and brings the thread sheet against the beam located in the winding position. There, the thread sheet is adhered against the adhesive strip. Because of the elasticity of the threads, the adhesion of the thread to the beam is not located at a single point but is extended over a certain length. Thereupon, the glow thread can be heated, whereby the influence of the heat severs the threads from the beam in the winding position. This has the advantage that no interfering thread ends remain on the beam to be wound, that is to say, that the beaming process can continue an even manner from the first thread layer and furthermore, the fully wound beam which has been removed from the winding position, is now severed from the thread sheet.

BRIEF DESCRIPTION OF THE DRAWINGS

The invention can be described with respect to its preferred embodiments, in conjuction with the drawings which show.

DETAILED DESCRIPTION OF THE DRAWINGS

Figure 1:
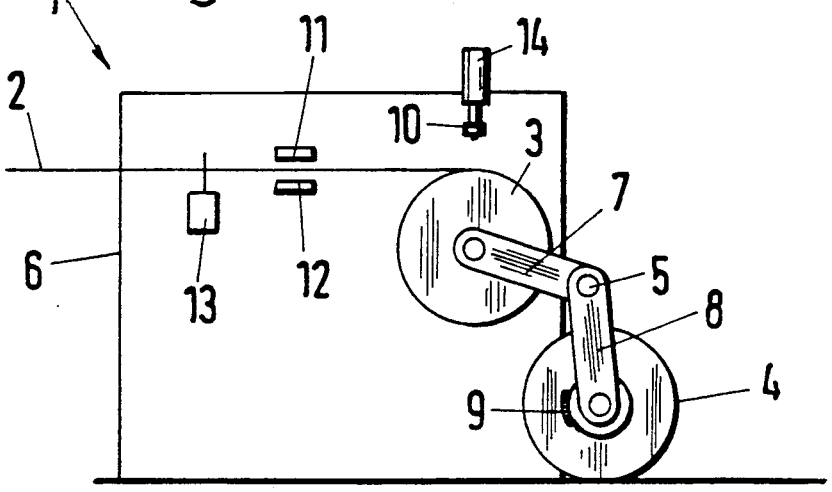
FIG. 1 is a side elevational schematic view of a warping arrangement with two beams in a first position viewed from 1—1 of FIG. 6.
Figure 7:
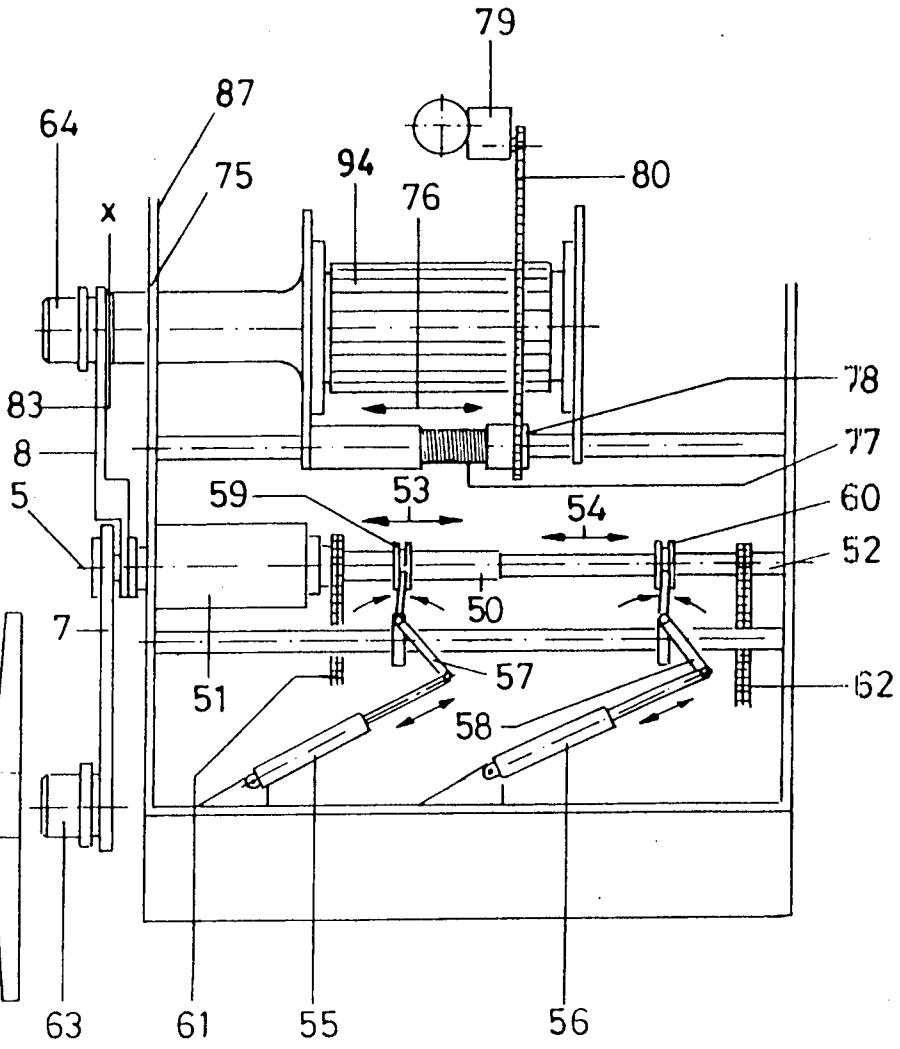
FIG. 7 is a partial cross-sectional elevational front view of the right side of the machine housing view from the right of FIG. 1.
Figure 6:
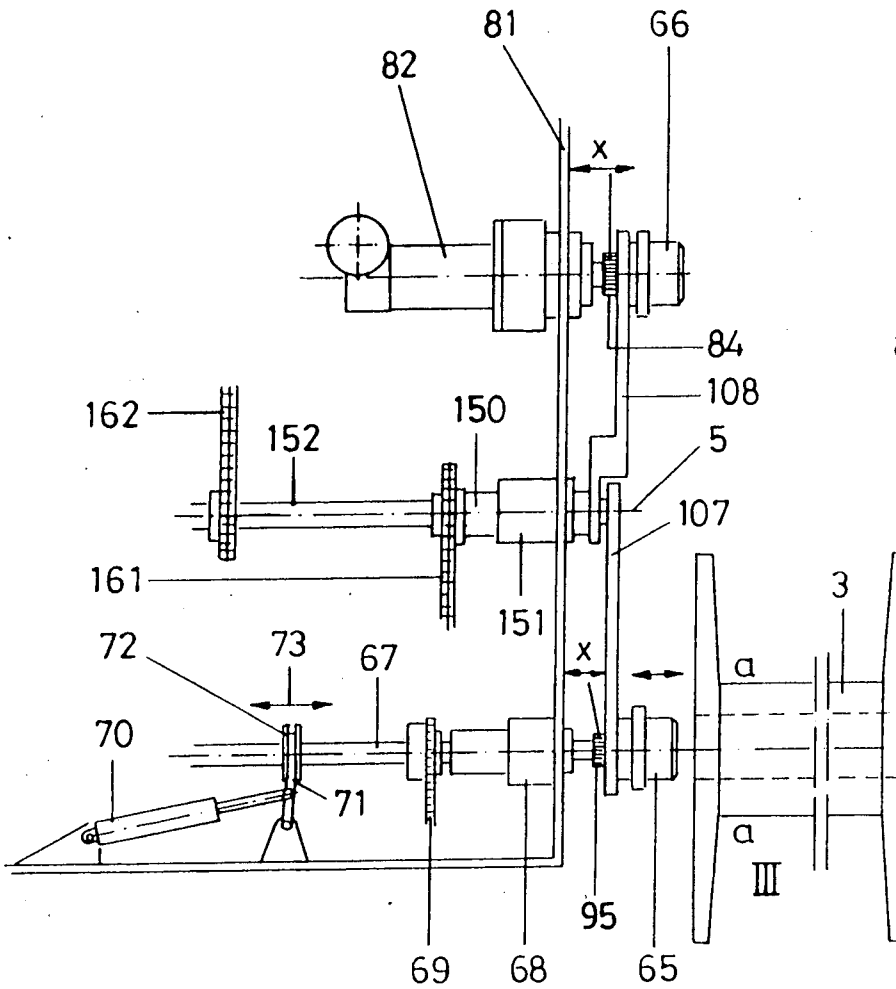
FIG. 6 is a partial cross-sectional elevational front view of the left hand portion of the machine housing viewed from the right of FIG. 1.

A side-by-side combination of FIGS. 6 and 7 shows a complete cross-sectional elevational front view of the machine viewed from the right of FIG. 1.

FIG. 6, shows the left side of the machine and FIG. 7 shows the right side of the machine. If the two figures are laid side by side there is provided a complete cross-sectional elevational view of the machine with beam 3 in discharge position III wherein beam III is disconnected from levers 7 and 107. The levers 7, 107 and 8, 108 are swingable about a common axis of rotation 5 thus, lever 108 is connected with shaft 50 which is rotatably carried by bearing 51. Similarly with respect to lever 8 the shaft 150 is hollow, through shaft 50 a further shaft 52 is led with which the lever 7 is fixedly connected similarly with respect to lever 107. The shafts 50 and 52 may be axially displaced in the direction of arrows 53 and 54. The activation force for the axial displacement is provided by piston cylinder means 55 and 56. When the piston of piston cylinder means 55 and 56 are extended, lever rods 57 and 58 move, respectively, muffs 59 and 60 which are attached to beams 50 and 52 enabling them to be moved in axial directions 53 and 54. The muffs 59 and 60 are however, so connected as to permit rotation of the beams 50 and 52.

The beams 50, 150 and 52, 152 are rotated by means of independent drives so that levers 7, 107 and 8, 108 also rotate. In order to achieve this end each shaft is provided with chains 61, 161 and 62 and 162 which respectively are connected with motor means which are not shown. The motors may be provided with a very low translation for example, with a worm gear. When the beam 3 is found in the discharge position III and the levers 7, 107 are swung into the same position by shaft 52, 152 the piston cylinder means 56 is brought into operation. This displaces the shaft 52 to the left in the direction of arrow 54 whereby the lever 57 is equally moved to the left. The distal end of lever 7 has an insert 63 which may be led into the core of beam 3. When the shaft 52 moves further to the left the beam 3 is pushed onto a corresponding insert 65 on the opposite lever 107. The beam 3 is rotatable upon insert 63. On the opposite machine side (FIG. 6) a drive motor (not shown) is provided which operates shaft 67 via chain 69 which is rotatable in and axially displaceable in bearing 68. A piston cylinder means 70 is provided which can move beam 67 in the axial direction of arrow 73 by means of rod 71 acting upon muff 72. When the beam 3 is pushed onto insert 65 the cylinder piston means 70 pushes the beam 67 to the right in the direction of arrow 73 whereby a toothed beam takeup 95 is introduced into insert 65 and interacts with the corresponding toothed internal circumference of said insert 65. This then provides a power connection between the shaft 67 and the beam 3. A motor (not shown) for the beam packing and cleaning operation activates shaft 67 by means of chain 69 whereby beam 3 is similarly rotated. The slowly rotating beam 3 can now be cleaned. This rotation can be readily interrupted.

When the beam take up 95 is removed from insert 65, beam 3 can be swung by means of levers 7, 107 and drives 62, 162 into the position illustrated in FIGS. 6 and 7 by levers 8, 108. Needless to say, in this case the levers 8, 108 will have to have been previously moved out of this position.

The levers 8, 108 are shown in the winding position I. At the ends of the lever 8, 108 not connected to shafts 50, 150 there are respectively located inserts 64, 66 which correspond to the inserts 63 and 65 at the ends of levers 7, 107.

Motor 94 is provided for the warping of the beam. The motor 94 is located in housing 75 to be axially moveable in the direction of arrow 76. In order to drive the motor in the direction of arrow 76 a worm gear 77 is provided which turns on spindle 78 by means of motor 79 driving chain 80. By means of this worm gear 77 the rotational movement of spindle 78 is translated into a lateral movement in the direction of arrow 76.

On the opposite left hand machine side there is provided, in housing 81, a similar beam holding arrangement 82, both beam holding arrangements move toothed beam takeup means 83 and 84 axially into inserts 64 and 66 in order to connect said insert 64 and 66 with the beam. The movement of beam takeups 83 and 84 can be carried out in an embodiment not illustrated in a pneumatic manner by means of a pneumatically controlled piston cylinder means. The piston cylinder means comprise an integrated clamping arrangement in which, in case of power failure, the piston cylinder means are locked in their momentary positions and further axial movement is prevented.

Before the levers 8, 108 can be swung, the toothed beam takeups 83 and 84 must be moved out of the inserts 64 and 66. This is achieved by means of drives 79 and 82. After the inserts 64 and 66 are freed the levers 8, 108 can be swung and the levers 7, 107 can be moved into the winding position. When the levers 7, 107 are in the winding position, the beam drive motor 74 and the takeup arrangement 82 are moved towards each other so that the toothed beam takeups 83 and 84 are moved into inserts 63 and 65 on levers 7, 107 respectively so that a power transfer connection is established between the inserts 63 and 65 and the beam 3. As soon as the drive motor 74 is put into operation beam 3 will be moved.

In a warping arrangement a sheet 2 is wound onto a first beam 3. The beam is rotatably supported in bearings at the end of a beam carrier in the form of levers 7, 107. The other ends of said levers being rotatable about an axis 5 attached to housing 8, 87 and 81. The levers 7, 107 are rotatable about axis 5 without angular limitation, wherein they are setable in positions I, II and III. In the embodiment illustrated in FIG. 1, beam 3 is in position I.

Figure 4:
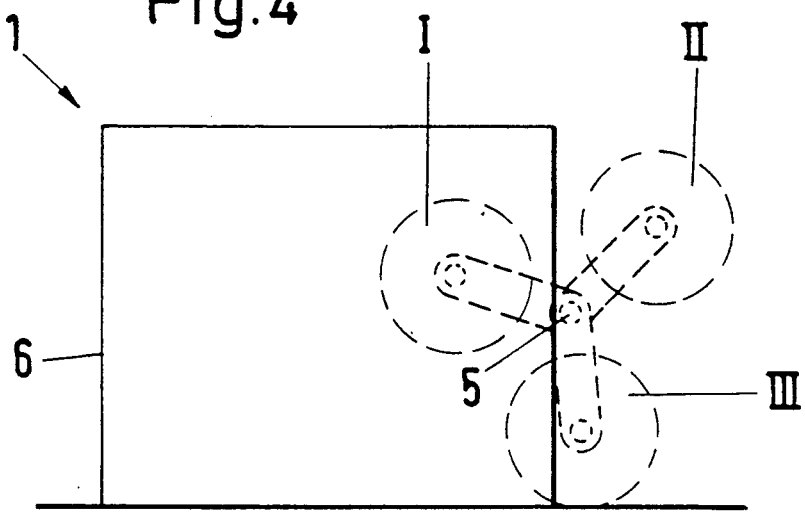
FIG. 4 is a side elevational schematic view of a of the three possible beam positions viewed from 1—1 of FIG. 6.

About the same axis there is provided a second beam carrier in the form of levers 8, 108 about which, at their further ends, is provided with beam 4. Levers 8, 108 are constructed in the exactly the same manner as levers 7, 107 and are also rotatable about axis 5 in a manner not limited to angle and are fixable in positions I, II and III, as shown in FIG. 4. Both beams 3 and 4 are moveable independently of each other. As is shown in FIG. 1, when beam 3 is completely wound, that is to say, has performed a predetermined number of revolutions or has taken up a predetermined length of thread, an adhering arrangement comprising components 11 and 12 brings an adhesive strip 15 to the thread sheet, thereafter, levers 7, 107 swing beam 3 from winding position I into packing position II. At the same time, levers 8, 108 moves the empty, that is to say, un-wound beam, from removal position III into the winding position I. The second beam 4, while in the removal position III, had previously been cleaned and prepared by laying an adhesive strip 9 onto the core 17. A fixing arrangement 10 activated by drive 14, is moved downwardly and brings thread sheet 2 onto the adhesive strip 9 on the second beam 4. A main reed 13 for guiding the thread sheet and the counter-bearing 12 of the adhering arrangement 11 and 12, are thus moved downwardly. The fixing arrangement 10 may comprise, on the side towards position 2, a knife which can also serve as a severing arrangement, which cuts the thread sheet on the second beam 4. The thread sheet 2 is now in position on the core of the second beam 4 while the threads which are fixed by adhesive strip 15, fall downwardly. No thread ends remain on the second beam 4. The second beam 4 can be immediately driven and start to be wound whereby, right from the start, an error-free winding is possible since the thread sheet 2 now ends on the core 17 of the second beam.

The first beam 3 now finds itself in the packing position II where it is accessible from all sides. While the second beam 2 is already being wound or warped, the first beam 3 can be packed up which the accessibility on all sides of this packing position facilitates considerably.

After the beam 3 is packed, levers 7, 107 are moved into the removal position III, where it can be set domn on the ground or on pallet. In this position, beam 3 is removed from beam carriers 7, 107 and transported away from the arrangement. A third un-wound beam, can now be moved to the carrier 7, 107 which is in the correct height position. In this position, it can be cleaned and prepared for warping. It is more advantageous however if levers 7, 107 move the beam back into the packing position 11, since then the service person has easier access to the beam. Both sets of levers 7, 107 and 8, 108 have an independent drive so that for example, levers 7, 107 can be swung backwards and forwards without the need to move levers 8, 108. In the packing position II, the beam can be inspected, cleaned and prepared by provision of the adhesive strip on the core. After completion of the preparation, the beam is moved back into removal position III, whereby the position illustrated in FIG. 1 is again obtained.

Figure 2:
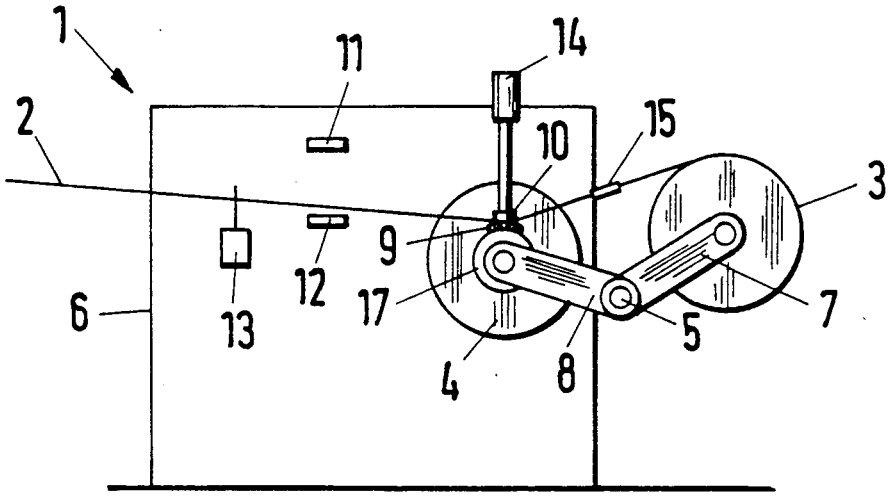
FIG. 2 is a side elevational schematic view of a warping arrangement with both beams in a second position viewed from 1—1 of FIG. 6.
Figure 3:
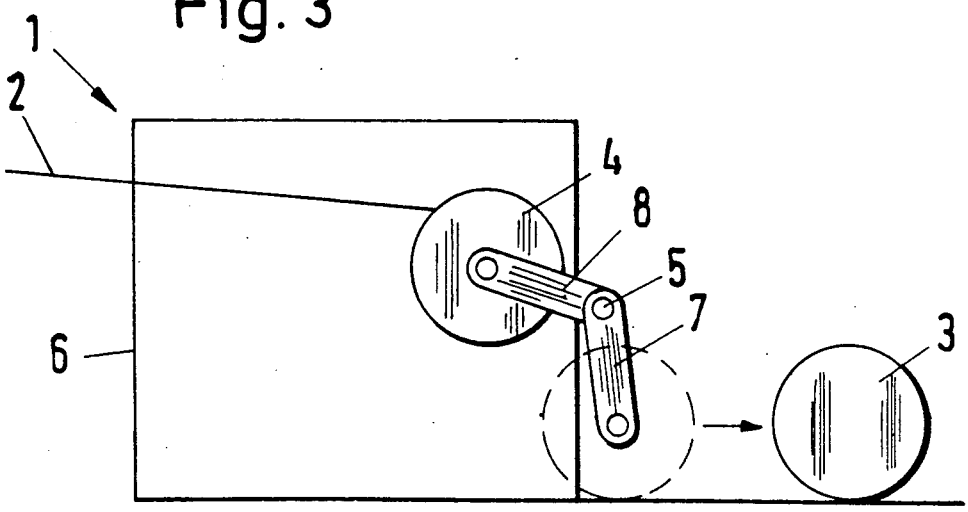
FIG. 3 is a side elevational schematic view of a warping arrangement with both beams in a third position viewed from 1—1 of FIG. 6
Figure 5:
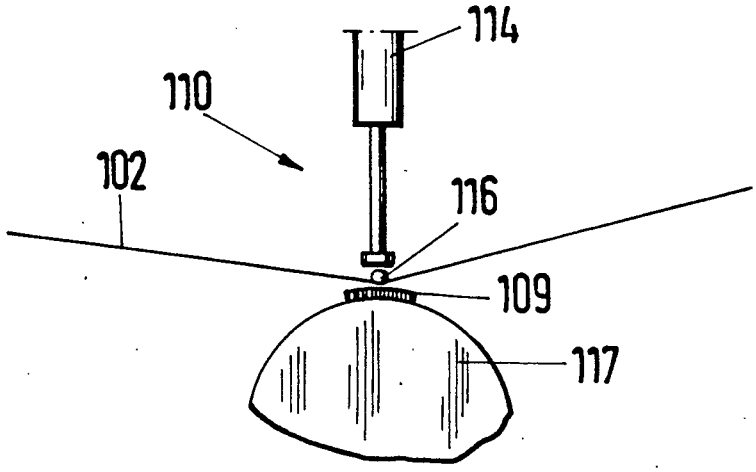
FIG. 5 is a side elevational schematic view of a further embodiment showing the thread severing arrangement viewed from 1—1 of FIG. 6.

FIG. 5 shows a further embodiment of the fixing arrangement. Elements illustrated in FIGS. 1 through 3, are raised by 100 units. The drive 114 presses a glow wire 116 across the thread sheet 102 and thus brings the thread sheet 102 into contact with adhesive strip 109 on the beam core 117. Since the threads as well as the adhesive strip 109 have a certain elasticity, the contact between the thread sheet 102 and the adhesive strip 109 is not located at a single point but rather extends over a short distance. During the pressing stage, the glow wire 116 is heated and thus severs the threads which are affixed to the second beam from those threads which are warped on the first beam as part of thread sheet 102, which extend to the first sheet. Thus, the second beam can begin to turn and take up the thread sheet while the first beam is being packed and removed from the arrangement. When the threads and core are made of suitable materials, the glow thread can weld the two together without the need for adhesive or the use an adhesive strip in order to obtain adhesion to the core.

We claim:

1. A process for the changing of a plurality of beams and for winding a thread sheet, comprising the steps of:

winding a first one of the beams in a winding position;

moving the first one of the beams from the winding position into a packing position wherein the first one of the beams is accessible from all sides;

loading a non-wound, second one of the beams from a loading/removal position into the winding position;

bringing the thread sheet into contact with the second one of the beams;

attaching the thread sheet to said second one of the beams;

severing said thread sheet from the first one of the beams while the first one of the beams is at said packing position;

moving said first one of the beams to said loading-/removal position;

removing said first one of the beams from said loading/removal position; and loading a third one of the beams into the loading-/removal position while the second one of the beams is being wound.

2. A process according to claim 1, wherein the removing of the first one of the beams occurs contemporaneously with the loading of the second one of the beams.

3. A process according to claim 1, wherein the loading and discharge movements of the beams describe swinging motions about a common axis.

4. A process in accordance to claim 1 wherein the third one of the beams is swung into the packing position for cleaning prior to winding.

5. A process in accordance with claim 1, wherein the thread sheet is severed only at the second beam.

6. A process in accordance with claim 5, wherein the attaching of the thread sheet to the second one of the beams occurs simultaneously with the severing of the thread sheet from the first one of the beams beam.

7. A process for the changing and winding a plurality of beams with a thread sheet and employing adhesive bands, adhesive strips and a warping arrangement having means for positioned a first one of the beams and at least a second one of the beams in at least two predetermined positions, wherein each of the beams is provided with one of the adhesive bands before winding of the thread sheet, comprising the steps of:

winding the first one of the beams at a first one of the predetermined positions;.

moving the first one of the beams from said first one of the predetermined positions, into a second one of the predetermined positions;

loading the second beam, non-wound, into the first one of the predetermined positions, to be wound;

bringing the thread sheet into contact with said second one of the beams;

attaching the thread sheet to said second one of the beams;

severing said thread sheet from said first one of the beams while it is still in the warping arrangement; and securing the thread sheet with one of said adhesive strips to the first one of beams, after winding.

8. A warping arrangement employing an adhesive strip and operable to carry out a beam changing process and to wind a thread sheet on a first and second beam, wherein said first beam, fully wound, is moved out of a winding position, while said second beam, non-wound, is moved into the said winding position, comprising:

a frame, a first carrier means mounted on said frame for releasably and rotatably holding said first beam;

a second beam carrier means mounted on said frame for releasably and rotatably holding said second beam, said first and said second beam carrier means being mutually independently operable to move and hold the first and second beam, respectively in either of at least two predetermined positions, one of them being the winding position for warping the thread sheet, said second beam carrier means being operable to move into the winding position while the said first beam carrier means is being moved out of said winding position, said first beam carrier means being operable to move into the winding position while the second beam carrier means is being moved out of said winding position; and an adhering means for securing the thread sheet with said adhesive strip onto either one of said first or second beam, when wound.

9. An arrangement in accordance with claim 8, further comprising:

a common axis means having a common axis and affixed to the frame of said arrangement, wherein the first and the second beam carrier means each include a lever rotatable about said common axis.

10. An arrangement in accordance with claim 9, wherein the first and second beam carrier means are movable into and affixable into three predetermined positions, wherein the first of said positions is the winding position, the second of said positions being a packing position at which either the first or second beam, fully wound, is accessible from all sides, the third of said positions being a removal position at which either the first or second beam is removable from the arrangement.

11. An arrangement in accordance with claim 10, wherein each of the first and second beam carrier means comprises an independent drive means for rotating each about the common axis between the predetermined positions.

12. An arrangement in accordance with claim 8, wherein the first and second beam carrier means are movable into and affixed into three predetermined positions, wherein the first of said positions is the winding position, the second of said positions being a packing position at which either the first or second beam, fully wound, is accessible from all sides, the third of said positions being a removal position wherein at which either the first or second beam is removable from the arrangement.

13. An arrangement in accordance with claim 12, wherein each of said first and second beam carrier means includes an independent drive means.

14. An arrangement in accordance with claim 8, wherein each of the first and second beam carrier means comprises an independent drive means for moving each between the predetermined positions.

15. An arrangement according to claim 8, further comprising a fastening means for moving the thread sheet against either the first or second beam when empty and located in the winding position.

16. An arrangement in accordance with claim 15, wherein the fastening arrangement comprises a thread severing arrangement.

17. An arrangement according to claim 16, wherein the thread severing arrangement is a glow wire.

18. An arrangement according to claim 8 wherein each of the beams is provided before winding with an adhesive band and the adhering means is operable to bring the thread sheet into contact with the adhesive band.

* * * * *